US006254502B1

(12) United States Patent
Becker

(10) Patent No.: US 6,254,502 B1
(45) **Date of Patent: *Jul. 3, 2001**

(54) WEIGHTING SYSTEM FOR SPORTS BALLS AND HITTING IMPLEMENTS

(75) Inventor: Roland Becker, Jungwat Phrae (TH)

(73) Assignee: Sport Fun, Inc., Los Angeles, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/678,664

(22) Filed: Jul. 11, 1996

(30) Foreign Application Priority Data

Jul. 14, 1995 (AU) ..... PN 4163

(51) Int. Cl.[7] ..... A63B 43/00

(52) U.S. Cl. ..... 473/594; 473/595; 473/567; 473/519

(58) Field of Search ..... 473/519, 520, 473/457, 564–568, FOR 105, FOR 169, FOR 170, 570, 594, 599, 595

(56) References Cited

U.S. PATENT DOCUMENTS

| | | | | |
|---|---|---|---|---|
| 514,420 | * | 2/1894 | Jacobus | 473/519 |
| 1,120,757 | * | 12/1914 | Steinberger | 473/594 |
| 2,302,985 | * | 11/1942 | Voit et al. | 473/599 |
| 2,379,006 | * | 6/1945 | Johnson | 473/519 |
| 3,116,926 | * | 1/1964 | Owen et al. | 473/519 |
| 3,163,421 | * | 12/1964 | Matyko | 473/594 |
| 3,229,976 | * | 1/1966 | Allen, Jr. | 473/570 |
| 3,861,682 | * | 1/1975 | Fujii | 473/520 |
| 4,002,893 | * | 1/1977 | Newcomb et al. | 473/570 |
| 4,133,528 | * | 1/1979 | Koblick | 473/570 |
| 4,182,512 | * | 1/1980 | Kuebler | 473/521 |
| 5,000,451 | * | 3/1991 | MacDonald et al. | 473/594 |
| 5,066,012 | * | 11/1991 | Stark | 473/570 |
| 5,186,458 | * | 2/1993 | Redondo | 473/570 |
| 5,316,293 | * | 5/1994 | Hamilton | 473/570 |
| 5,380,003 | * | 1/1995 | Lanctot | 473/520 |

* cited by examiner

*Primary Examiner*—Mark S. Graham
(74) *Attorney, Agent, or Firm*—Fulwider Patton, et al.; Ellsworth R. Roston

(57) ABSTRACT

Closure members are provided at the opposite ends of a hollow casing. Shock absorbers are confined within the casing by the closure members. A weight is disposed within the casing between the shock absorbers. The weight may be defined by a plurality of granules confined within an enclosure in the casing between the shock absorbers. Alternatively, the weight may be defined by a solid member. The casing may be in the shape of a baseball bat. Alternatively, a tube may be disposed within the casing and may be closed by the end caps. The shock absorbers and the weight may be confined within the tube by the end caps. The arrangement described above may also be provided in different types of balls. For example, end caps may be provided at the opposite ends of a hollow main body shaped to define the central portion of a football. Shock absorbers may be disposed with the hollow main body at positions interior to the end caps. A weight may be disposed within the hollow main body between the shock absorbers. The weight may be solid or formed from granules. Stoppers may be disposed in the hollow main body between the shock absorbers and the end caps. The stoppers may be glued at first ends to the shock absorbers and at second ends to the end caps.

11 Claims, 1 Drawing Sheet

WEIGHTING SYSTEM FOR SPORTS BALLS AND HITTING IMPLEMENTS

This application is a continuation of application Ser. No. 08/678,664 filed Jun. 11, 1996.

The present invention relates to a ball hitting sports implement or sports ball and relates particularly, though not exclusively, to baseball or cricket bats, golf clubs, hockey sticks, tennis racquets and similar products.

BACKGROUND OF THE INVENTION

In view of the expensive nature of ball hitting sports implements or balls it is common practice to provide cheaper alternatives when training. Such implements are usually made of a plastics material, for example, foamed or flexible or rigid polyurethane, polyethylene, neoprene or similar materials. Traditionally, such implements or balls have lacked the necessary weight and/or weight distribution of regulation equipment and thus do not provide a realistic and specific training effect of regulation equipment.

BRIEF DESCRIPTION OF THE INVENTION

It is an object of the present invention to provide a ball hitting sports implement or sports ball made from a plastics material which has the necessary weight and weight distribution to provide a more accurate simulation of the regulation implement or ball.

With this object in view the present invention may provide in a preferred aspect a ball hitting sports implement or sports ball having an outer body of rubber or plastics material and an internal cavity for reception of a weighting device for said implement or ball.

In one preferred embodiment said cavity includes at least one shock absorber abutting said weighting device. Preferably said at least one shock absorber comprises a shock absorber abutting opposite ends of said weighting device. In a further preferred embodiment a pair of shock absorbers are provided at opposite ends of said weighting device. In a practical embodiment said weighting device is in granular form.

In yet a further preferred embodiment said weighting device is formed of a solid or hollow shock absorbing material, e.g. a resilient high density solid rubber.

In one embodiment of the invention, closure members are provided at the opposite ends of a hollow casing. Shock absorbers are confined within the casing by the closure members. A weight is disposed within the casing between the shock absorbers. The weight may be defined by a plurality of granules confined within an enclosure in the casing between the shock absorbers. Alternatively, the weight may be defined by a solid member. The casing may be in the shape of a baseball bat. Alternatively, a tube may be disposed within the casing and may be closed by the end caps. The shock absorbers and the weight may be confined within the tube by the end caps.

The arrangement described above may also be provided in different types of balls. For example, end caps may be provided at the opposite ends of a hollow main body shaped to define the central portion of a football. Shock absorbers may be disposed with the hollow main body at positions interior to the end caps. A weight may be disposed within the hollow main body between the shock absorbers. The weight may be solid or formed from granules. Stoppers may be disposed in the hollow main body between the shock absorbers and the end caps. The stoppers may be glued at first ends to the shock absorbers and at second ends to the end caps.

BRIEF DESCRIPTION OF THE DRAWINGS

This and other aspects of the present invention will be more fully described with reference to the accompanying drawings, in which.

DETAILED DESCRIPTION OF THE INVENTION

Figure 1:
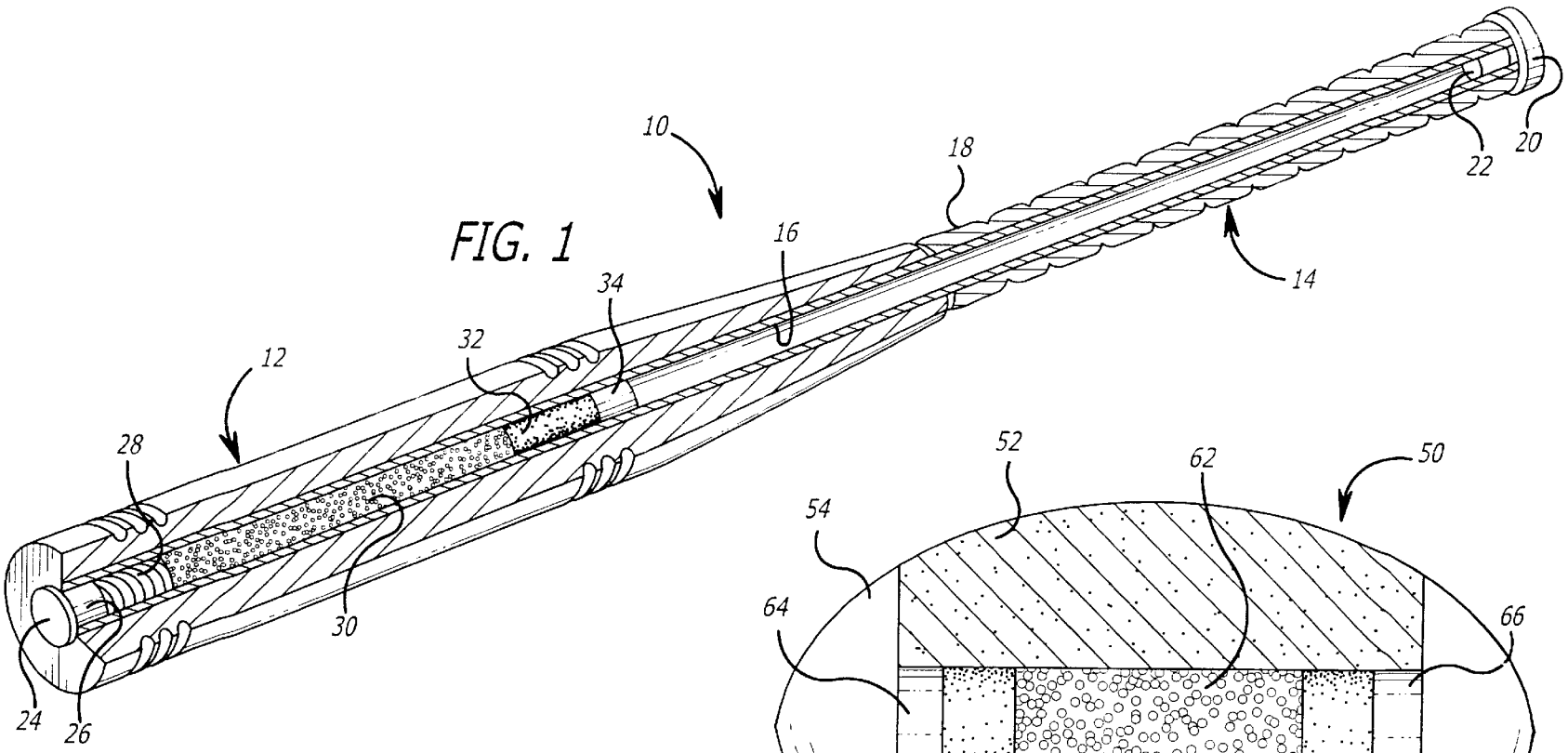
FIG. 1 is a cross-sectional view of a baseball bat made in accordance with the invention.

In FIG. 1 there is shown a baseball bat 10 having a hitting section 12 and a handle section 14. A hollow tube 16 extends the length of bat 10. Tube 16 is preferably formed of a flexible plastics material. Tube 16 is surrounded by hitting section 12 which may be formed of a suitable plastic material, for example, foamed, flexible or rigid polyurethane, polyethylene, neoprene or other suitable material. Tube 16 is a force fit in hitting section 12. A grip 18 is applied to tube 16 to form handle section 14. An end cap 20 slides over tube 16 and is force fitted into tube 16 by a stopper 22 integrally formed with end cap 20. At the other end an end plug 24 is forced fitted to tube 16 by stopper 26 integrally formed with end plug 24.

Inside tube 16 is a shock absorber 28, also force fitted, and which may be formed of any suitable material, e.g. rubber. A weighting device 30 abuts shock absorber 28 and at the other end abuts a further shock absorber 32. To prevent movement of weighting device 30 and shock absorber 32, a stopper 34, e.g. rubber, is force fitted into tube 16. Shock absorber 32 may or may not have the same density or compression as shock absorber 28.

Although two shock absorbers 28, 32 have been shown, additional shock absorbers (not shown) may be inserted if desired or required.

Weighting device 30 is preferably formed of granular material, e.g. metal, plastics or other material which is preferably contained in a thin bag or tube. Weighting device 30 can be varied in weight, size and position in tube 16 to allow simulation in balance, centre of percussion and/or centre of gravity of a regulation baseball bat.

The shock absorber 28 will absorb centrifugal forces exerted by weighting device 30 during a high speed swing by a batter. The shock absorber 28 and stopper 32 will also dampen vibrations caused along bat 10 on impact with a ball (not shown). This dampening will reduce material fatigue from repetitive use and the probability of breakage. In the event of breakage the granular nature of weighting device 30 will provide a harmless explosion of granules rather than the danger of a flying solid mass. The flexible nature of shock absorbers 28 and 32, weighting device 30 and stopper 34 substantially reduces shear stress lines in tube 18 as the whole bat 10 flexes during high speed swing by a batter and ball contact.

In variations of this embodiment tube 7 can be omitted. Bat 10 can be hollow and the various components secured inside the cavity formed by the hollow nature of the bat. Weighting device 30 can also be replaced by a high density resilient solid rubber tube which is a friction fit within bat 10 or tube 16. Such a rubber tube would not require shock absorbers as the rubber tube would provide shock absorption and dampening. This rubber tube is preferably hollow but could be solid, if required. Although the embodiments have been described with reference to their application to a baseball bat it is clear that the invention can be used in other sporting implements, e.g. cricket balls, golf clubs, tennis rackets, etc.

Figure 2:
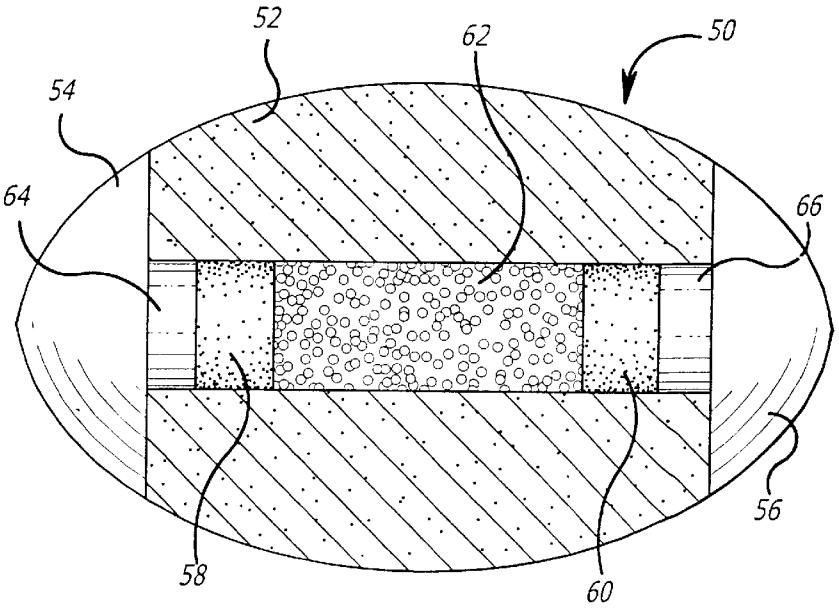
FIG. 2 is a cross-sectional view of a football made in accordance with the present invention.

FIG. 2 shows a football 50 having a main body 52 and end caps 54, 56. These components can be formed of a plastics or rubber material, e.g. foamed, flexible or rigid polyurethane, polyethylene, neoprene or similar material. Main body 52 is hollow for reception of shock absorbers 58, 60. Abutting shock absorbers 58, 60 is a weighting device 62 similar in construction to the weighting device 30 described with reference to FIG. 1. Stoppers 64, 66 are glued to end caps 54, 56 or integrally formed therewith. End caps 54, 56 are glued to main body 52 to complete assembly of the football 50.

Football 50 can be constructed to simulate the weight and balance of a regulation football by varying the components inside the hollow. The shock absorption and dampening will be similar in nature to baseball bat 10 in FIG. 1. Although this embodiment has been described with reference to a football the inventive concepts can be used in a range of sports balls, e.g. soccer, tennis, golf and other balls.

The ball such as the football 50 has a balanced weight distribution in axial and radial directions, even when the ball is thrown or kicked, where the radial direction is perpendicular to the axial direction. In the ball such as the football 50, the body or casing 52 has opposite ends in the axial direction and has an annular configuration in the radial direction. The body or casing 52 has an opening 70 extending axially at central positions in the radial direction.

A hollow tube 72 may extend through the body or casing 52 and defines and maintains the opening 70. The hollow tube 72 may correspond in the embodiment shown in FIG. 2 to the tube 16 in the embodiment shown in FIG. 1. The shock absorbers 58 and 60, the weighting device 62 and the stoppers 64 and 66 are disposed within the opening 70 defined by the hollow tube 72. The end caps 54 and 56, the shock absorbers 58 and 60, the weighting device 62 and the stoppers 64 and 66 have a symmetrical disposition relative to the central position in the axial direction and relative to the opening 70 at the center of the body 50 in the radial direction.

The ball such as the football 50 has a balanced weight distribution in axial and radial directions, even when the ball is thrown or kicked, where the radial direction is perpendicular to the axial direction. In the ball such as the football 50, the body or casing 52 has opposite ends in the axial direction and has an annular configuration in the radial direction. The body or casing 52 has an opening 70 extending axially through the body at central positions in the radial direction.

The shock absorbers 58 and 60, the weighting device 62 and the stoppers 64 and 66 are disposed within the opening 70 [defined by the hollow tube 72]. The end caps 54 and 56, the shock absorbers 58 and 60, the weighting device 62 and the stoppers 64 and 66 have a substantially symmetrical disposition relative to the central position in the axial direction and relative to the opening 70 at the center of the body 50 in the radial direction.

The end caps 54 and 56 have substantially identical constructions and are symmetrically disposed in the radial direction. The shock absorbers 58 and 60 have substantially identical constructions and are symmetrically disposed in the radial direction. The stoppers 64 and 66 have substantially identical constructions and are symmetrically disposed in the radial direction.

It is believed that the invention and many of its attendant advantages will be understood from the foregoing description and it will be apparent that various changes may be made in the form, construction and arrangement of the parts and that changes may be made in the form, construction and arrangement of the ball hitting sports implement or sports ball described without departing from the scope and spirit of the invention or sacrificing all of its material advantages, forms hereinbefore described being merely preferred embodiments hereof.

What is claimed is:

1. A ball having a balanced weight distribution in axial and radial directions, even when the ball is thrown or kicked, where the radial direction is perpendicular to the axial direction, including, a casing having opposite ends in the axial direction and having an opening extending axially at central positions in the radial direction, the casing being disposed symmetrically in the radial direction from the axially extending opening and being disposed symmetrically in the axial direction, closure members at the opposite axial ends of the casing, the closure members at the opposite axial ends having a substantially identical construction and being disposed symmetrically in the radial direction, shock absorbers disposed within the opening in the casing at the opposite axial ends of the casing, the shock absorbers being confined within the casing by the closure members, the shock absorbers at the opposite axial ends having a substantially identical construction and being disposed symmetrically in the radial direction, stoppers disposed within the opening in the casing between the closure members and the shock absorbers at the opposite axial ends of the casing and in abutting relationship with the closure members and the shock absorbers, the stoppers at the opposite axial ends of the casing having a substantially identical construction and being disposed symmetrically in the radial direction, and a weight disposed within the opening in the casing between the shock absorbers and made from a granular material, the casing being in the shape of the ball.

2. In a combination as set forth in claim 1 wherein the ball is a football and wherein the shock absorbers are attached to the stoppers and the stoppers are attached to the end caps.

3. A ball having a balanced weight distribution in an axial direction and in a radial direction, even when the ball is thrown or kicked, where the radial direction is perpendicular to the axial direction, including, a body having opposite ends in the axial direction and having an annular configuration in the radial direction and having an axially extending opening at the center of the body in the radial direction, end caps disposed at the axial opposite ends of the body, the end caps having a substantially identical construction and being symmetrical in the radial direction, shock absorbers disposed within the opening in the body at positions interior to the end caps at the opposite axial ends of the body, the shock absorbers having a substantially identical construction and being symmetrical in the radial direction, and a weight disposed within the opening in the body between the shock absorbers and made from a granular material.

4. A ball as set forth in claim 3, including, stoppers disposed within the opening in the body between the shock absorbers and the end caps and in abutting relationship at their opposite ends to the shock absorbers and the end caps, the stoppers having a substantially identical construction and being symmetrically disposed in the radial direction, the body, the end caps, the weight, the shock absorbers and the stoppers having a symmetrical disposition relative to a central position in the axial direction and relative to the opening at the center of the body in the radial direction.

5. In a combination as set forth in claim 3 wherein the body and the end caps define the shape of the ball.

6. A ball having a balanced weight distribution in axial and radial directions, even when the ball is thrown or kicked, where the radial direction is perpendicular to the axial direction, including, a body with an opening extending in the axial direction in the body at centrally located positions in the radial direction, end caps disposed at the opposite ends of the body in the axial direction, the end caps having a substantially identical construction and being symmetrically disposed in the radial direction, shock absorbers disposed within the openings in the body at positions interior to the end caps at the opposite ends of the body in the axial direction, the shock absorbers having a substantially identical construction and being symmetrically disposed in the radial direction, and a weight disposed within the opening in the body between and in abutting relationship with the shock absorbers, the weight being formed from granules confined in the opening in the body between the shock absorbers, and stoppers disposed in the opening in the body between the shock absorbers and the end caps in the axial direction and in abutting relationship at their opposite ends with the shock absorbers and the end caps, the stoppers having a substantially identical construction and being symmetrically disposed in the radial direction, the body, the end caps, the shock absorbers, the weight and the stoppers at the opposite ends of the body having a symmetrical relationship in the axial and radial directions.

7. In a combination as set forth in claim 6, the body having a symmetrical disposition in the axial and radial directions, the opening in the body having a symmetrical disposition in the axial and radial directions, the weight, the shock absorbers and the stoppers having a symmetrical disposition in the opening in the body.

8. In a combination as set forth in claim 7, the stoppers being attached to the end caps, and the shock absorbers being attached to the stoppers.

9. In a combination as set forth in claim 7 wherein the body and the end caps define the shape of a football.

10. In a combination as set forth in claim 8 wherein the body and the end caps define the shape of the ball.

11. In a combination as set forth in claim 8 wherein the body and the end caps define the shape of a football.

* * * * *

UNITED STATES PATENT AND TRADEMARK OFFICE

CERTIFICATE OF CORRECTION

PATENT NO. : 6,254,502 B1
DATED : July 3, 2001
INVENTOR(S) : Roland Becker

It is certified that error appears in the above-identified patent and that said Letters Patent is hereby corrected as shown below:

Drawings,
FIG. 2, add -- 70 -- with feeder line as shown below:

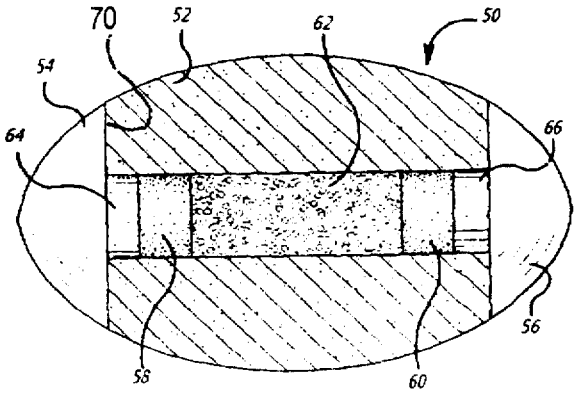

Column 3,
Lines 27-39, delete entire paragraph.
Line 51, delete "[defined by the hollow tube 72]".

Column 4, claim 1,
Line 20, after "casing,", add -- at positions removed from the opening in the casing, --.

Column 4, claim 2,
Line 43, move entire line up to be a continuation of line 42.

Signed and Sealed this

Fifth Day of February, 2002

*Attest:*

*Attesting Officer*

JAMES E. ROGAN
*Director of the United States Patent and Trademark Office*